US009856124B2

(12) United States Patent
Mitidieri

(10) Patent No.: US 9,856,124 B2
(45) Date of Patent: Jan. 2, 2018

(54) DEVICE FOR OPENING GLASS AMPOULES

(71) Applicant: SINTETICA S.A., Mendrisio (CH)

(72) Inventor: Augusto Mitidieri, Lugano (CH)

(73) Assignee: Sintetica S.A., Mendrisio (CH)

( * ) Notice: Subject to any disclaimer, the term of this patent is extended or adjusted under 35 U.S.C. 154(b) by 111 days.

(21) Appl. No.: 14/760,267

(22) PCT Filed: Jan. 10, 2014

(86) PCT No.: PCT/EP2014/050356

§ 371 (c)(1),
(2) Date: Jul. 10, 2015

(87) PCT Pub. No.: WO2014/108488

PCT Pub. Date: Jul. 17, 2014

(65) Prior Publication Data

US 2015/0353334 A1 Dec. 10, 2015

(30) Foreign Application Priority Data

Jan. 11, 2013 (IT) ..... MI2013A0033

(51) Int. Cl.
*B67B 7/92* (2006.01)

(52) U.S. Cl.
CPC ..... *B67B 7/92* (2013.01); *Y10T 225/30* (2015.04)

(58) Field of Classification Search
CPC ..... B67B 7/92; Y10T 225/30; Y10T 225/20; Y10T 225/208; Y10T 225/213; Y10T 225/214
See application file for complete search history.

(56) References Cited

U.S. PATENT DOCUMENTS 2,447,988 A * 8/1948 Pierson ..... B67B 7/92 30/164.9
2,515,020 A * 7/1950 Scott ..... B67B 7/92 225/96.5

(Continued)

FOREIGN PATENT DOCUMENTS

GB 2081692 A 2/1982
WO 02/100763 A1 12/2002

OTHER PUBLICATIONS

PCT International Search Report for corresponding PCT/EP2014/050356, filed Jan. 10, 2014 (dated May 16, 2014).

*Primary Examiner* — Jonathan Riley
(74) *Attorney, Agent, or Firm* — LeClairRyan, a Professional Corporation

(57) ABSTRACT

This invention relates to an ampoule opening device (1) for the opening of glass ampoules (100) of the type used in particular in the pharmaceutical field for injection substances. The device according to this invention allows opening, by rupture of the neck of the ampoule, glass ampoules of different capacities (and therefore of sizes), by generating a non irregular rupture edge and therefore minimizing the creation of glass fragments that may fall into the substance contained within the ampoule. Moreover, the device object of this invention allows avoiding contact of the user's fingers with the neck and the cap of the ampoule, thereby preventing any risk of accidental injuries. The device object of this invention allows obtaining excellent results in terms of quality of the rupture edge of the ampoule neck and of repeating the result obtained thanks to the fact that the device allows to apply to the ampoule a constant rupture bending moment for ampoules of the same type.

9 Claims, 5 Drawing Sheets

(56) References Cited

U.S. PATENT DOCUMENTS

| | | | | | |
|---|---|---|---|---|---|
| 3,450,319 | A * | 6/1969 | Campbell, Jr. | B67B 7/92 | 225/104 |
| 4,241,627 | A * | 12/1980 | Snow | B67B 7/92 | 294/99.2 |
| 4,637,139 | A * | 1/1987 | Chen | B26B 27/00 | 225/93 |
| 4,659,024 | A | 4/1987 | Frunzi et al. | | |
| D291,489 | S * | 8/1987 | Dudnyk | D24/127 | |
| 6,832,703 | B1 * | 12/2004 | Scott | B67B 7/92 | 222/1 |
| 7,946,461 | B2 * | 5/2011 | Wiley | B67B 7/92 | 225/1 |
| 2006/0112571 | A1 * | 6/2006 | Maffei | B67B 7/92 | 30/400 |
| 2011/0303716 | A1 * | 12/2011 | Pluska | B67B 7/92 | 225/103 |
| 2014/0263531 | A1 * | 9/2014 | Liu | B67B 7/92 | 225/105 |
| 2014/0331599 | A1 * | 11/2014 | Starr | B67B 7/92 | 53/381.1 |
| 2015/0329339 | A1 * | 11/2015 | Oberli | B67B 7/92 | 414/411 |

* cited by examiner

DEVICE FOR OPENING GLASS AMPOULES

This application is a national stage application under 35 U.S.C. §371 of PCT Patent Application Serial No. PCT/EP2014/050356, filed Jan. 10, 2014, which claims the priority benefit of Italy Application No. mi2013a000033, filed Jan. 11, 2013.

FIELD OF THE INVENTION

This invention relates to an ampoule opening device for the opening of glass ampoules of the type used in particular in the pharmaceutical field for injection substances.

As is known, glass ampoules of different capacities, from 1 ml to 30 ml, and of different shapes are commonly used for the containment of injection substances. These ampoules are handled daily and in very high quantities by health care professionals in hospitals and by individual patients who must follow particular therapies by themselves.

Some ISO Standards (ISO 9187-1 and ISO 9187-2) specify the materials, sizes, capacities, and requirements in terms of tensile strength and packaging of the three main types of ampoules in use in industry (known as type B, C and D, while type A has been abandoned).

In general, the ampoules of the type in object open on rupture of the neck of the ampoule, or by detachment of the "cap" from the cylindrical body of the ampoule. To ease rupture of the ampoule, at the neck of the ampoule thereof, a circumferential incision may be provided (in this case, it concerns so-called "score-break" ampoules) or a single point of breakage (OPC). In the first case, the orientation of the ampoule is indifferent with respect to the applied breaking force, while in the second case (OPC), it is necessary that the ampoule is properly oriented with respect to the application of the rupture force, and for this reason the position of the point of rupture is generally marked by a mark, typically a colored dot, positioned just above said point.

The above mentioned ISO Standards determine, as previously mentioned, both the dimensional parameters of the ampoules and the force required to cause the detachment of the cap from the body. The rupture force indicated by the Standards is that which is necessary to apply in a rupture test wherein a test machine applies a force perpendicular to the longitudinal axis of the ampoule exactly at the neck of the ampoule, according to what is shown in FIG. 1. The rupture force depends on the type and size of the ampoule, as given in the table shown in FIG. 2.

Therefore, the international Standards attempt to provide some parameters that should allow an easier opening of the ampoules by the user. In fact, the values of the rupture forces are determined whereby generally the user proceeds to break manually the ampoule, and therefore, it is necessary on the one hand that the rupture force remains within easy exercisable values manually, and on the other hand that the edge of rupture is as clean as possible, not fragmented, and this both to prevent undesired production of glass fragments that might fall within the ampoule thereof, and to avoid accidental injury of the user who could cut himself in breaking the ampoule.

PRIOR ART

Currently, on the market are known certain types of ampoule opening devices that have tried to provide answers to the above requirements in order to obtain a sharp edge of the ruptured ampoule and avoid the production of glass fragments during the opening.

Examples of such devices are for example described in EP1033344A1, which shows an ampoule opening device consisting of a hollow cylindrical part able to accommodate the cap of the little ampoule and a second part able to accommodate the body of the ampoule, with a connection part which joins the two parts. The device is made of flexible and elastic material, so that the user can grasp the two parts of the device and manually exert the bending moment required to break the neck of the ampoule.

Another example of a device known from the state of the art is described in GB2349640. This device allows the user, who grasps the body of the ampoule, to insert the cap in a housing formed on the device and suitably shaped to accommodate caps of ampoules of different sizes. When the user exerts a rupture force on the ampoule, it breaks at the neck, which rests on the edge of the housing of the device, and the cap of the ampoule falls within the device.

These, such as other solutions of the type known from the state of the art, however, have several drawbacks.

A first drawback, common also to the devices object of the above mentioned patents, consists in the fact that the rupture force applied by the user is never constant. In fact, both the point of application and the intensity of the applied force are variable. In the device described in EP1033344A1 the force exerted by the user is variable, allowing in practice the device only to insert the ampoule in a casing, but leaving the user the burden of applying the force required to cause rupture of the neck.

In the device described in GB2349640, not only the magnitude of the applied force is at the discretion of the user, but also positioning of the neck of the ampoule at the correct point of the shaped housing is left to the user. In this way, the user will be able to insert more or less in depth the ampoule in the device, or position the neck of the ampoule at a wrong point of the shaped housing, corresponding to an ampoule of larger sizes, thereby introducing a degree of uncertainty about the precise point of application of the applied rupture force.

The fact that the applied rupture force may vary makes the line of rupture of the neck of the ampoule not homogenous, which at times can rupture in a sharp way, and at times irregular.

Furthermore, in both devices described by the previously cited patents and in the other devices of the known type from the state of the art, the applied rupture force by the user can have not only a bending component, but also an axial component, for example of traction, which influences the final result in terms of edge rupture.

SUMMARY OF THE INVENTION

The main purpose of this invention is therefore to provide an ampoule opening device for opening glass ampoules which allows the user to detach the cap from the body of the ampoule at its neck by minimizing or eliminating the production of fragments of glass, and creating a straight edge devoid of sharp ridges.

The production of glass fragments is highly undesirable because fragments may fall within the ampoule constituting a risk for the patient, while a ruptured irregular edge is undesirable as it can cause, during the operation of manual opening, the accidental wounding of the user.

Within this task, the purpose of this invention is to provide an ampoule opening device which allows the application of a rupture force of the ampoule substantially constant, thanks to the kinematics of the device thereof.

Furthermore, the purpose of this invention is to provide an ampoule opening device that can be used with ampoules of different capacities, in particular which can be used with ampoules of 5 ml, 10 ml, and 20 ml.

The purpose of this invention is also to provide an ampoule opening device that allows avoiding any contact by the user with the rupture edge of the neck of the ampoule.

Still, the purpose of this invention is that to provide a device able to collect in a special compartment inside the device thereof, the cap of the ampoule that is detached from the body after rupture of the neck.

Not least, the purpose of this invention is that to provide an ampoule opening device that can be grasped with only one hand by the user, and which is extremely intuitive in use, not requiring special attentions by the user other than to position correctly the ampoule with respect to the device, an operation which the user is anyhow guided by suitable reference marks present on the device.

This task, and these and other purposes that will become more apparent in the following detailed description of this invention given here by way of illustration and non-limitative, are achieved by an ampoule opening device as cited in the annexed claims.

In particular, the device object of this invention can be grasped by the user with only one hand, and comprises a main body equipped with a stop and guide element for positioning the cap of the ampoule on said main body being hinged at a rotation axis perpendicular to the longitudinal axis of the device and a positioning and grasping element of the body of the ampoule adapted to receive the body of said ampoule, between said positioning element and grasping of the body of the ampoule and said main body being further provided by elastic means for damping the force exerted by the user on said positioning and grasping element of the body of the ampoule.

Said rotation axis of said positioning and grasping element of the body of the ampoule is positioned on said main body between said stop and guide element for the correct positioning of the cap of the ampoule and the application point of the force by the user.

The device according to this invention is also characterized by the fact that it comprises a cavity specially provided within the main body adapted to receive the cap of the ampoule which is detached from the body of the ampoule thereof.

BRIEF DESCRIPTION OF THE FIGURES

Further characteristics and advantages of this invention will become more apparent from the following detailed description, given as a non-exhaustive example and illustrated in the annexed Figures wherein.

DETAILED DESCRIPTION OF THE INVENTION

Figure 1:
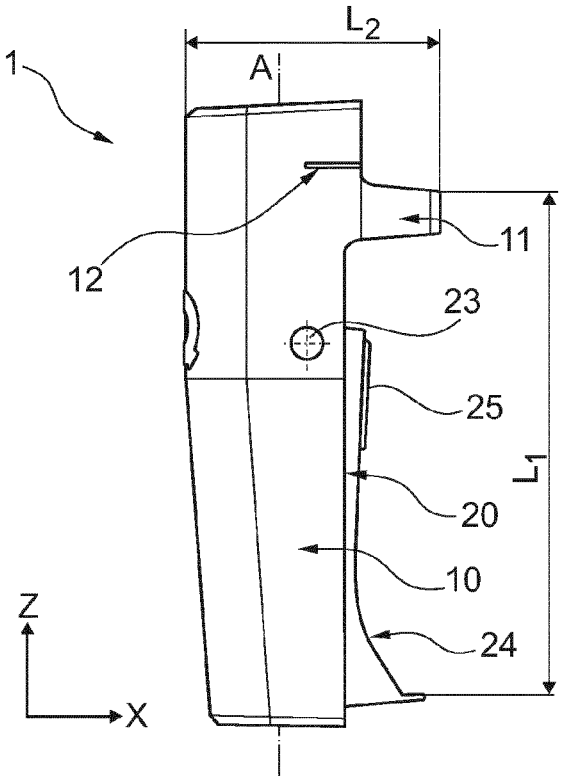
FIG. 1 shows a side view of a first version of the ampoule opening device according to this invention.

With special reference to the above mentioned Figures, the ampoule opening device 1 according to this invention comprises a main body 10 which has a substantially longitudinal shape to be grasped with only one hand by the user. With reference to FIG. 1, the main body 10 has an elongated box-shape along longitudinal axis A open at the front, so that a cavity 13 is defined inside the main body 10. Reference is made to FIG. 1 which shows a plan view of the device on an XZ plane, and to FIG. 2 which shows a front view on the YZ plane.

Therefore, the main body 10 has preferably, on a frontal plane, a substantially rectangular profile, while preferably at the rear it has a rounded shape so that it can be more easily grasped by the user.

Identified with reference to FIG. 1 the Cartesian Z axis direction as the vertical direction, the ampoule opening device 1 according to this invention has an upper end at which protrudes in the front a stop and guide element 11 for positioning of the cap of the ampoule 100.

Preferably, said stop element has an annular shape in order to insert the cap of the ampoule between said main body 10 and said annular element 11, according to what is shown, for example, in FIGS. 3 to 6.

Still at the upper end of said main body 10, the device advantageously has a reference 12, which can be constituted by an incision or by a graphic mark such as, for example, a line, which visually guides the user in positioning correctly the top of the cap of the ampoule 100.

To the main body 10 is hinged a positioning and grasping element of the body of the ampoule 20.

Said positioning and grasping element of the body of the ampoule 20 is shaped to be inserted in the front in said main body box 10, which, as previously mentioned, is open in the front. More in detail, said positioning and grasping element of the body of the ampoule 20, also has a substantially elongated shape, and has on a vertical transverse plane ZY a substantially rectangular profile, and is hinged at a pair of pins 23 to said main body 10, said pair of pins defining a rotation axis I for said positioning and grasping element of the body of the ampoule 20 with respect to said main body 10.

Said positioning and grasping element of the body of the ampoule 20 in turn comprises elastic means 22 acting between said element 20 and the main body 10.

Figure 3:
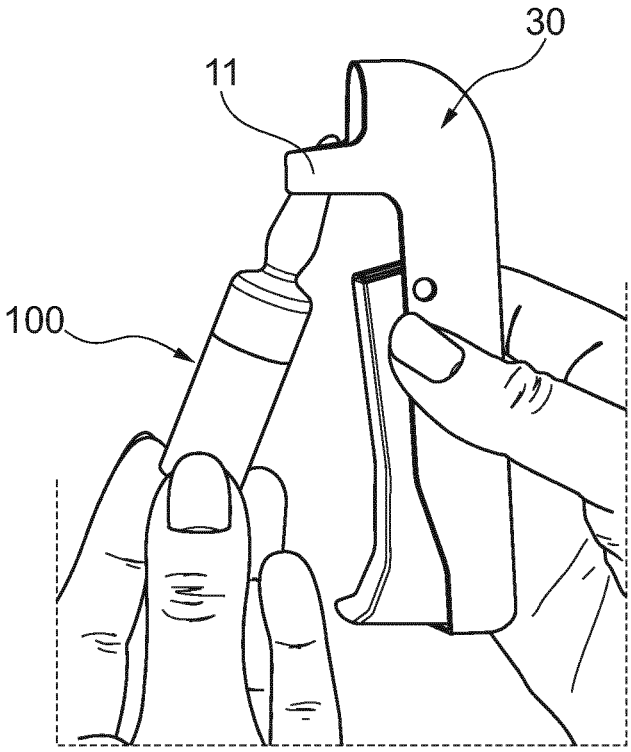
FIG. 3 shows the positioning of an ampoule on the device by an operator; the device has a main body rounded at the top, according to an alternative embodiment compared to that shown in FIGS. 1 and 2.
Figure 4:
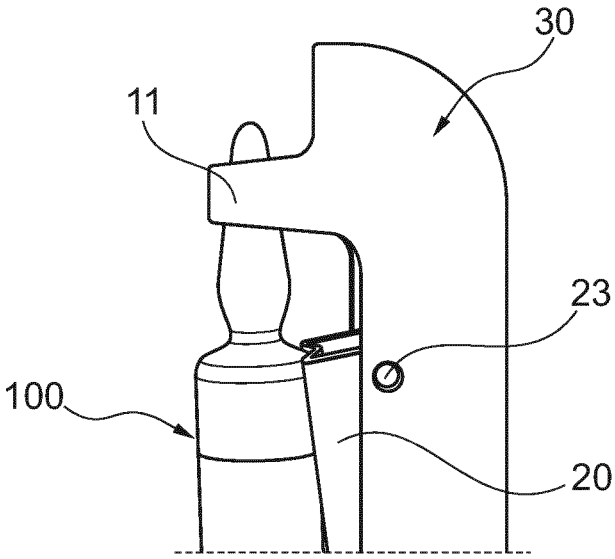
FIG. 4 shows in particular the correct positioning of the ampoule in the device of FIG. 3.
Figure 5:
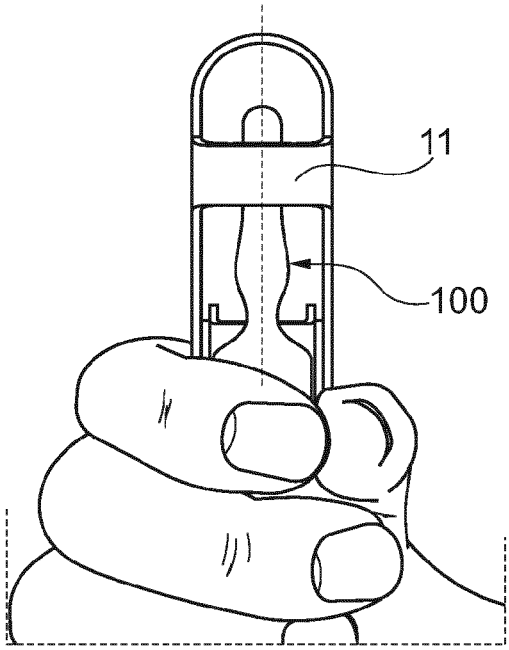
FIG. 5 shows a front view of the ampoule opening device according to this invention wherein the ampoule is correctly positioned, the device and the ampoule being grasped by the user with only one hand.
Figure 6:
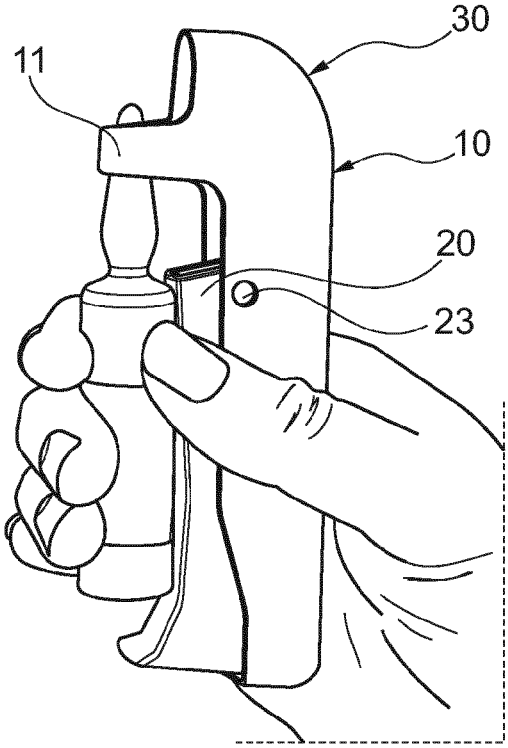
FIG. 6 shows a side view of the front view of FIG. 5.
Figure 9:
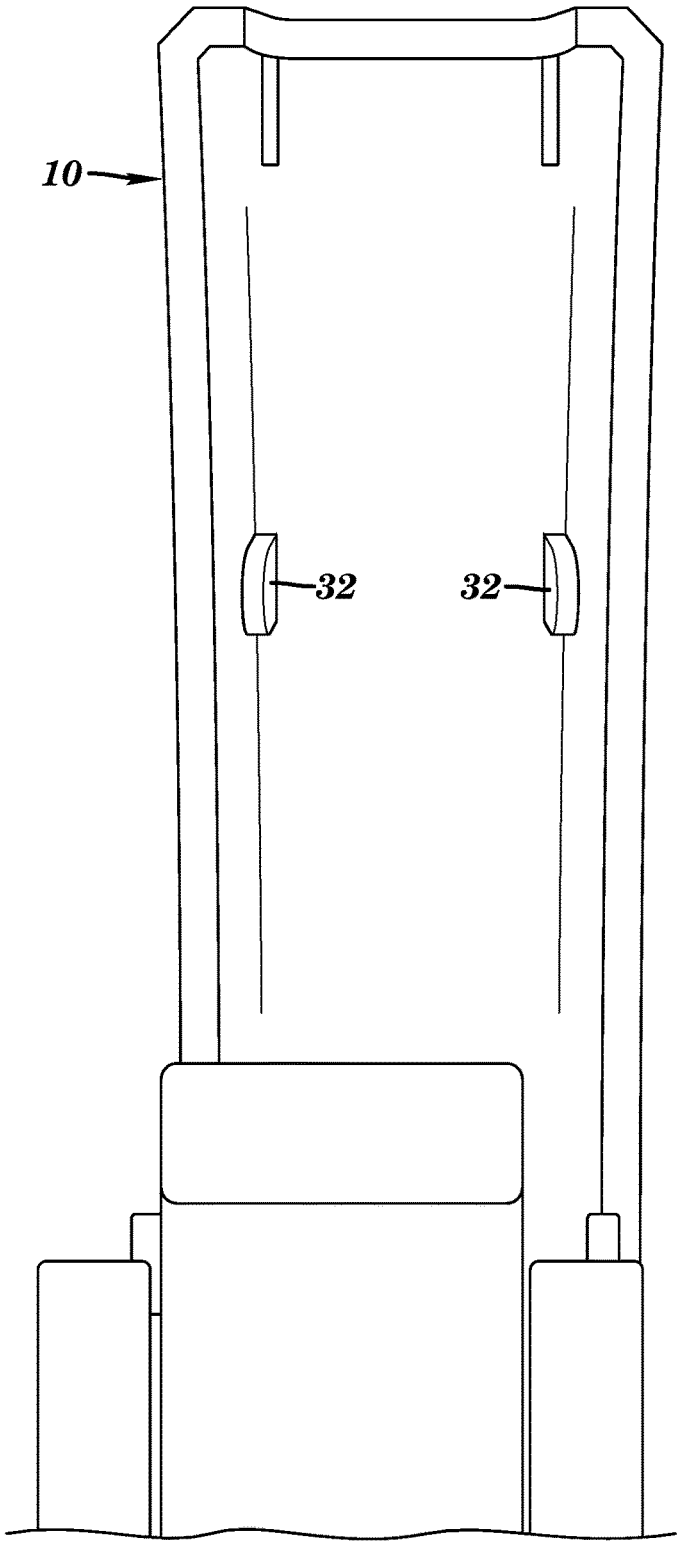
FIG. 9 shows a portion of internal cavity of the main body of the ampoule opening device according to this invention in on open configuration.

In the configuration of use, said positioning and grasping element 20 of the body of the ampoule is therefore partly inserted into the front opening of said main body box in shape 10, and said elastic means, which are preferably constituted by a pair of flexible fins 22 adapted to contact specific stops 32 as shown in FIG. 9, provided internally to said main body box 10, contribute to maintain said element 20 in the first rest position wherein the front surface of said positioning and grasping element of the body of the ampoule is substantially aligned along the vertical direction Z, with the said stop element 11, so that the user can easily position the ampoule as shown in FIGS. 3 and 4, with the body of the ampoule that rests against the front surface of said element 20 and the cap that is inserted within the annular stop 11.

Advantageously, the front surface 24 of said positioning and grasping element of the body of the ampoule has, in a longitudinal vertical plane XZ a slightly curved profile, with the concavity facing internally and therefore this front surface 24 is not aligned with the vertical direction Z.

This arrangement is such that when the user positions the ampoule on the device said ampoule is, on a vertical plane XZ, slightly inclined forward (the front position is that of the X axis, indicated in the Figures) with respect to the Z axis, so that the ampoule is slightly preloaded when said element 20 is in rest position. In this way, a slight pressure by the user on the ampoule 100 is sufficient to generate a bending moment sufficient to rupture the ampoule thereof.

In fact, the ampoule opposes to the rotation of the element of positioning and grasping 20 of the body of the ampoule about the axis I identified by the pins 23, but to a greater force applied by the user on the body of the ampoule, due to the rotation ability of the element 20 about the pins 23, amplifies the bending moment acting on the cap of the ampoule until generating the rupture of the latter at the neck of the ampoule thereof.

Figure 7:
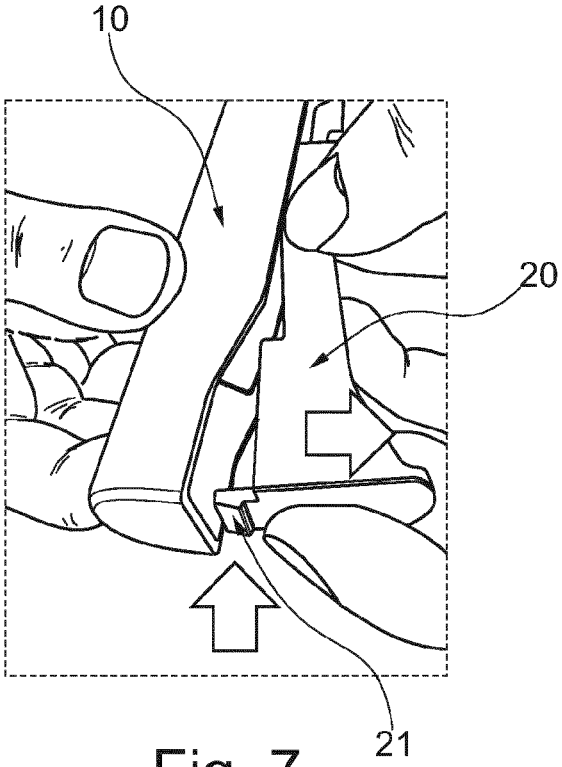
FIG. 7 shows a detail of the ampoule opening device according to this invention, in particular the opening phase of the device by the user.
Figure 8:
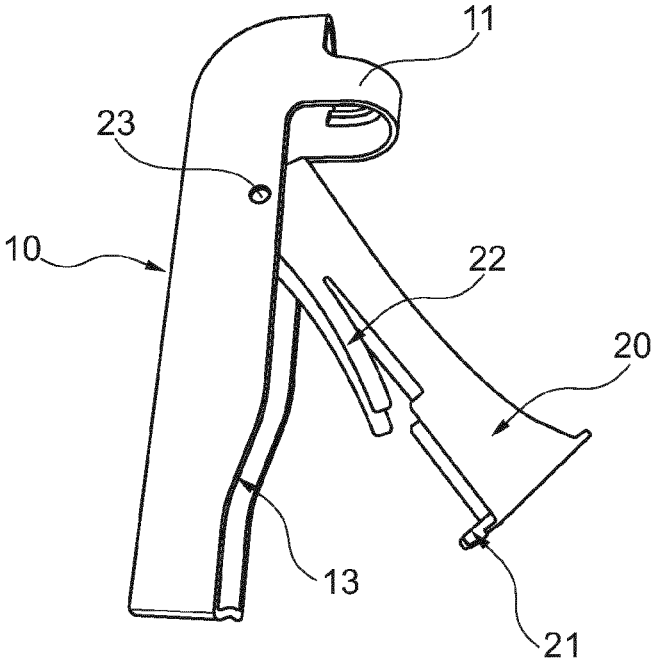
FIG. 8 shows the ampoule opening device according to this invention in an open configuration, which allows extracting the cap of the ampoule from the internal cavity of the device thereof.

Furthermore, as shown in particular from FIGS. 7 and 8, the opening means 21 of said positioning and grasping element of the body of the ampoule 20 with respect to said main body 10. In the embodiment example illustrated in the annexed Figures, such opening means are constituted by a tab 21 positioned below said positioning and grasping element 20 and protruding towards the inside of said main body 10 and which ends with a grasping tooth.

In this way, the opening means 21 maintain said positioning and grasping element 20 of the body of the ampoule in the configuration, closed, of use, shown, for example, in FIGS. 1 to 6.

In this configuration, the user can rest the body of the ampoule at the front surface of said positioning and grasping element of the body of the ampoule 20 and the latter remains movable between a first rest position, not compressed, wherein said elastic means push said positioning and grasping element 20 of the body of the ampoule towards the outside of said main body 10, and a second compressed position wherein said elastic means 22 are compressed and said positioning and grasping element 20 of the body of the ampoule is pushed by the user within said main body 10 as much as is allowed by the deformability of said elastic means 22 which are compressed.

The positioning and grasping element 20 of the body of the ampoule therefore turns hinged about the axis I defined by the pins 23 as much as allowed by the deformability of the elastic means 22. When the operator has properly positioned the body of the ampoule 100 against the front surface of said positioning and grasping element 20 of the body of the ampoule, by taking care to properly position the top of the cap of the ampoule at the reference mark 12, by inserting the cap thereof inside the stop annular element 11 for the cap of the ampoule, he may tighten with his fingers (see FIGS. 5 and 6) the ampoule causing rotation of the positioning element 20 and, consequently, a rotation of the ampoule thereof in the vertical plane XZ, shown in FIG. 1.

The rotation of the body of the ampoule takes places uniformly on rotation of the positioning and grasping element 20 since the body rests against said element and is retained in this rest position by grasping of the user while the cap of the ampoule stops against the annular element 11.

Therefore, a bending moment is generated on the cap of the ampoule due to the presence of the annular element 11, which generates the rupture of the neck of the ampoule thereof.

Thanks to the mechanics described so far, in particular thanks to the fact that ampoules with different capacities, and therefore sizes, are positioned at different heights while keeping constant the positioning point of the cap identified by the reference mark 12 and the point of application of the stop given by the constant position of the annular element 11, there is uniformity in the value of the applied force. To further adjust the applied force, also contribute the elastic means 22 acting between said positioning and grasping element 20 of the ampoule and the main body 10 of the device, which dampen the force applied by the user, besides contributing to return said positioning and grasping element 20 of the ampoule in its uncompressed rest position. Thanks to these measures, the device according to this invention allows the user to apply the same rupture force for the same type of ampoule, the arm of the moment being bound (given by the position of the cap with respect to the ampoule annular stop 11).

The uniformity of the applied force during the opening is reflected in the obtained result in terms of non irregular rupture edge and in terms of reduction or absence of production of glass fragments.

When rupture occurs in the neck of the ampoule 100, the device according to this invention, in particular the inner surface of the cavity 13 of said main body 10, at the upper portion 30 of the main body 10 which is connected with the back wall of the main body 10, has on a longitudinal vertical plane XZ a characteristic curved profile, which allows the cap of the ampoule from falling within the cavity 13 defined internally to the main body 10.

The curved profile 30, shown in FIGS. 3 to 8, is not shown in FIGS. 1 and 3, since these Figures show a variant wherein is provided an outer casing which partially covers the main body 10, however, this curved profile of the upper portion 30 of the inner surface of the cavity 13 is also present in this version, internally to said casing cover, since the radius of curvature of this part and the distance, when the device is in use, between the ampoule and this curved profile were specially designed through several experimental tests to obtain that the cap of the ampoule, when hitting this curved profile, it does not bounce against the inner back wall of the cavity 13 of the main body 10 protruding from the cavity thereof.

Thanks to the particular curvature of the curved profile 30 the cap of the ampoule when it detaches from the body of ampoule is projected towards the inside of the main body 10, it bounces against the inner surface of the curved profile 30 and falls within the cavity 13.

Figure 2:
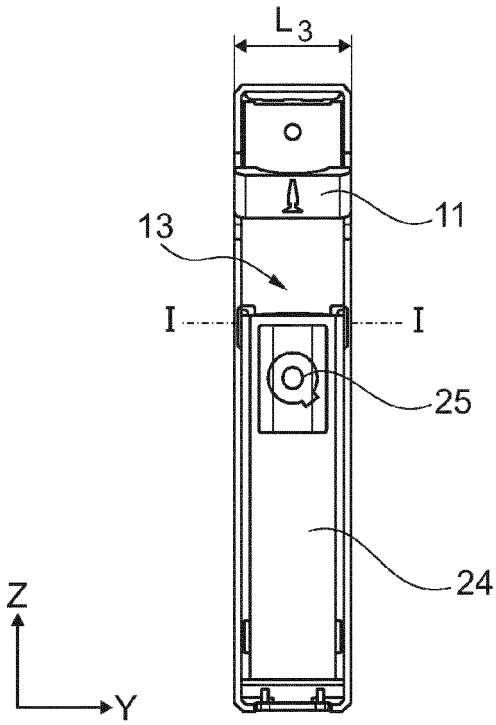
FIG. 2 shows a front view of the ampoule opening device according to this invention.

Advantageously, on the front surface of said positioning and grasping element 20 of the body of the ampoule, it can advantageously be provided an insert 25 in elastomer material or anyhow in a material having, in contact with the glass of the ampoule 100, a high coefficient of friction, adapted to prevent that the ampoule may slide with respect to said positioning and grasping element 20 of the ampoule. Further still, the dimensions of the ampoule opening device according to this invention are of fundamental importance. In particular, in FIGS. 1 and 2 are indicated by $L_1$, $L_2$, and $L_3$, some dimensional sizes that are of particular importance to achieve the desired technical result, which consists in a sharp rupture, without creation of glass fragments and without irregular edges of the neck of the ampoule.

Thanks to ampoule opening device according to this invention, by suitably sizing the dimensions $L_1$, $L_2$, and $L_3$, it is possible to obtain the desired results in terms of rupture of the ampoule with ampoules of 5 ml, 10 ml, and 20 ml of capacity.

In particular, it is the above mentioned Standards thereof that determine the distance, indicated by h5 in the Standards, between the base of the ampoule and the point of application of force, which is referable to the distance between the rest point of the base of the ampoule on said positioning and grasping element 20 of the body of the ampoule and the position of the annular stop 11, indicated in FIG. 1 with the dimension $L_1$.

The size h5 is therefore set by the Standards in 68 mm for the 5 cc ampoules, 87 mm for the 10 ml ampoules, and 100 mm for the 20 ml ampoules.

One of the purposes that this invention intends to resolve consists in the fact of using only one device in order to open ampoules of different capacities, and therefore sizes.

It was possible to check that when size $L_1$, corresponding to the distance between the base of the positioning and grasping element 20 of the body of the ampoule and the upper edge of said annular stop 11, as shown in FIG. 1, is chosen equal to 100 mm, the device according to this invention allows to effectively open 5, 10 and 20 ml ampoules simply by taking care to position the upper end of the cap of the ampoule at the reference mark 12.

In fact, the rest front surface of the positioning and grasping element 20 of the body of the ampoule is a continuous surface, and therefore it is possible for the user to rest on the said surface ampoules of different capacities, characterized by different height values of the ampoule (i.e., of the h5 size).

The dimension $L_2$ may preferably be equal to about 50 mm, while the dimension $L_3$, i.e. the width of the device, can preferably be about 24 mm. These sizes are chosen to accommodate ampoules of different sizes, from 5 ml to 20 ml, as previously mentioned, but with the same proportions, suitable devices can be made adapted to open ampoules of different capacities, and therefore sizes, by exploiting the same innovative concept.

The Standards thereof provide for the sizes of the ampoules tolerances of +/2 mm, which are perfectly compatible with the mechanics of the device according to this invention.

In this way, it was shown how the ampoule opening device according to this invention achieves the proposed purpose and objects.

In particular, it is shown how the ampoule opening device according to this invention allows opening glass ampoules of different capacities and with different pre-cuts of the neck of the ampoule (OPC, color break, score break) by recovering the cap of the ampoule after the opening and minimizing, if not completely eliminating, the production of glass fragments which may fall into the ampoule thereof during the opening operation.

Moreover, with the ampoule opening device according to this invention a rupture force is applied constant to the ampoule. In fact, as previously mentioned, in the first place, we have that to the ampoule is only applied a bending moment, avoiding, thanks to the fact that the ampoule has no axis constraints with respect to the axial annular stop 11, the application of forces to the axial component. In fact, it was shown experimentally that the presence of axial forces worsens the result that can be obtained in terms of quality of the rupture (non irregular edge and reduced or absent production of glass fragments).

The rupture force applied to the ampoule is then constant for the same type of ampoules thanks to the mechanics of the device thereof.

With the ampoule opening device according to this invention, there is only a mechanical opening of the ampoule, by this way avoiding that the operator's fingers are in contact with the cutting edge of the neck of the ampoule, eliminating the risk of injuries.

Furthermore, a further advantage achieved by the ampoule opening device according to this invention consists in the fact that it can be washed and disinfected both by gas and by steam in autoclavable.

Several modifications can be made by the skilled person in the field without departing from within the context of protection of this invention. Therefore, the context of protection of the claims, must not be limited by the illustrations or by the preferred embodiments shown in the description given as a non-exhaustive example, but rather the claims must include all the characteristics of patentable novelty deductible from this invention, including all the characteristics that would be treated as equivalent by the skilled person in the field.

The invention claimed is:

1. An ampoule opening device comprising:

a main body configured to be grasped by a user, said main body comprising at least a partial opening at an end, a stop element, and a guide element to position a cap of an ampoule, said stop element protruding from said main body; and a position and grasp element hinged to said main body to position and grasp a body of said ampoule which is at least partly inserted into the at least partial opening of said main body and an elastic element which acts between said position and grasp element and said main body, said position and grasp element being movable between a first resting position wherein said elastic element pushes said position and grasp element toward an outside of said main body, and a second compressed position wherein said position and grasp element is inserted within said main body to an extent allowed by deformation of said elastic element which is compressed, wherein said elastic element acting between said position and grasp element and said main body comprises a pair of flexible fins adapted to contact one or more stops provided inside said main body.

2. The ampoule opening device according to claim 1, wherein said main body is an elongated box comprising the at least partial opening, so as to be graspable by the user with a single hand.

3. The ampoule opening device according to claim 1, wherein said position and grasp element is shaped so as to be partly inserted inside the at least partial opening of said main body, and is hinged to said main body at a pair of pins, said pair of pins defining a rotation axis for rotating said position and grasp element with respect to said main body.

4. The ampoule opening device according to claim 1, wherein said position and grasp element comprises a surface configured to receive the body of said ampoule, said surface having, on a longitudinal vertical plane, a slightly curved profile, with concavity facing toward the surface.

5. The ampoule opening device according to claim 1, wherein said stop element for the cap of said ampoule is an annular element which protrudes from said main body and into which the cap of said ampoule may be introduced.

6. The ampoule opening device according to claim 5, further comprising:

a reference mark located on said main body and above said annular stop element which visually shows the user a point at which an upper end of the cap of the ampoule should be positioned.

7. The ampoule opening device according to claim 1, wherein said at least partial opening internally defined within said main body has a curved profile in a longitudinal vertical plane of the main body.

8. The ampoule opening device according to claim 4, further comprising an insert formed of an elastometric material located on said surface of said position and grasp element.

9. The ampoule opening device according to claim 5, wherein distance between a base of said position and grasp element and an edge of said annular stop element opposite said base is equal to 100 mm.

* * * * *